US006514403B1

(12) United States Patent
Louie et al.

(10) Patent No.: US 6,514,403 B1
(45) Date of Patent: Feb. 4, 2003

(54) HYDROCRACKING OF VACUUM GAS AND OTHER OILS USING A COCURRENT/COUNTERCURRENT REACTION SYSTEM AND A POST-TREATMENT REACTIVE DISTILLATION SYSTEM

(75) Inventors: Wai Seung Louie, Brooklyn, NY (US); Ujjal Kumar Mukherjee, Montclair, NJ (US); Gary Lee Hamilton, Shrewsbury, NJ (US)

(73) Assignee: ABB Lummus Global Inc., Bloomfield, NJ (US)

( * ) Notice: Subject to any disclaimer, the term of this patent is extended or adjusted under 35 U.S.C. 154(b) by 0 days.

(21) Appl. No.: 09/557,025

(22) Filed: Apr. 20, 2000

(51) Int. Cl.[7] ..... C10G 65/12; C10G 65/02

(52) U.S. Cl. ..... 208/58; 208/59; 208/89; 208/97

(58) Field of Search ..... 208/58, 59, 89, 208/97, 210

(56) References Cited

U.S. PATENT DOCUMENTS

| | | | | | |
|---|---|---|---|---|---|
| 2,952,626 | A | * | 9/1960 | Kelley et al. | 208/210 |
| 3,147,210 | A | | 9/1964 | Hass et al. | 208/210 |
| 3,256,178 | A | * | 6/1966 | Hass et al. | 208/110 |
| 3,365,388 | A | * | 1/1968 | Scott, Jr. | 208/110 |
| 3,365,391 | A | * | 1/1968 | Kelley | 208/216 PP |
| 3,767,562 | A | * | 10/1973 | Sze et al. | 208/143 |
| 3,775,291 | A | * | 11/1973 | Sze | 208/143 |
| 4,021,330 | A | * | 5/1977 | Satchell, Jr. | 208/144 |
| 4,430,203 | A | * | 2/1984 | Cash | 208/210 |
| 5,183,556 | A | | 2/1993 | Reilly et al. | 208/57 |
| 5,554,275 | A | * | 9/1996 | Harandi | 208/213 |
| 6,036,844 | A | * | 3/2000 | Gupta et al. | 208/143 |
| 6,153,086 | A | * | 11/2000 | Gupta et al. | 208/107 |
| 6,224,749 | B1 | * | 5/2001 | Gupta et al. | 208/210 |

* cited by examiner

*Primary Examiner*—Walter D. Griffin
(74) *Attorney, Agent, or Firm*—Alix, Yale & Ristas, LLP

(57) ABSTRACT

The invention relates to a hydrocracking and hydrotreating process for hydrocracking feedstock oils such as vacuum gas oil to produce diesel and lighter distillate products. A first hydrogenation process is carried out in a main reactor with the feedstock and hydrogen flowing cocurrently down through a top section containing a layered system of hydrotreating and hydrocracking catalyst. The feedstock is substantially desulfurized and denitrified, the aromatics are at least partially saturated and cracked products are formed. The vapor and liquid are separated in a disengaging zone below the top section and the liquid flows down through a bottom section also containing a layered catalyst system countercurrent to make-up hydrogen flowing up. The vapor removed from the disengaging zone and the liquid bottoms are then further processed in a post treatment catalytic distillation reactor having an upper catalytic distillation section and a lower stripping section which may also contain a catalyst. Hydrogen for recycle and hydrogen sulfide and ammonia are removed from the post treatment reactor vapors leaving the product distillates.

5 Claims, 1 Drawing Sheet

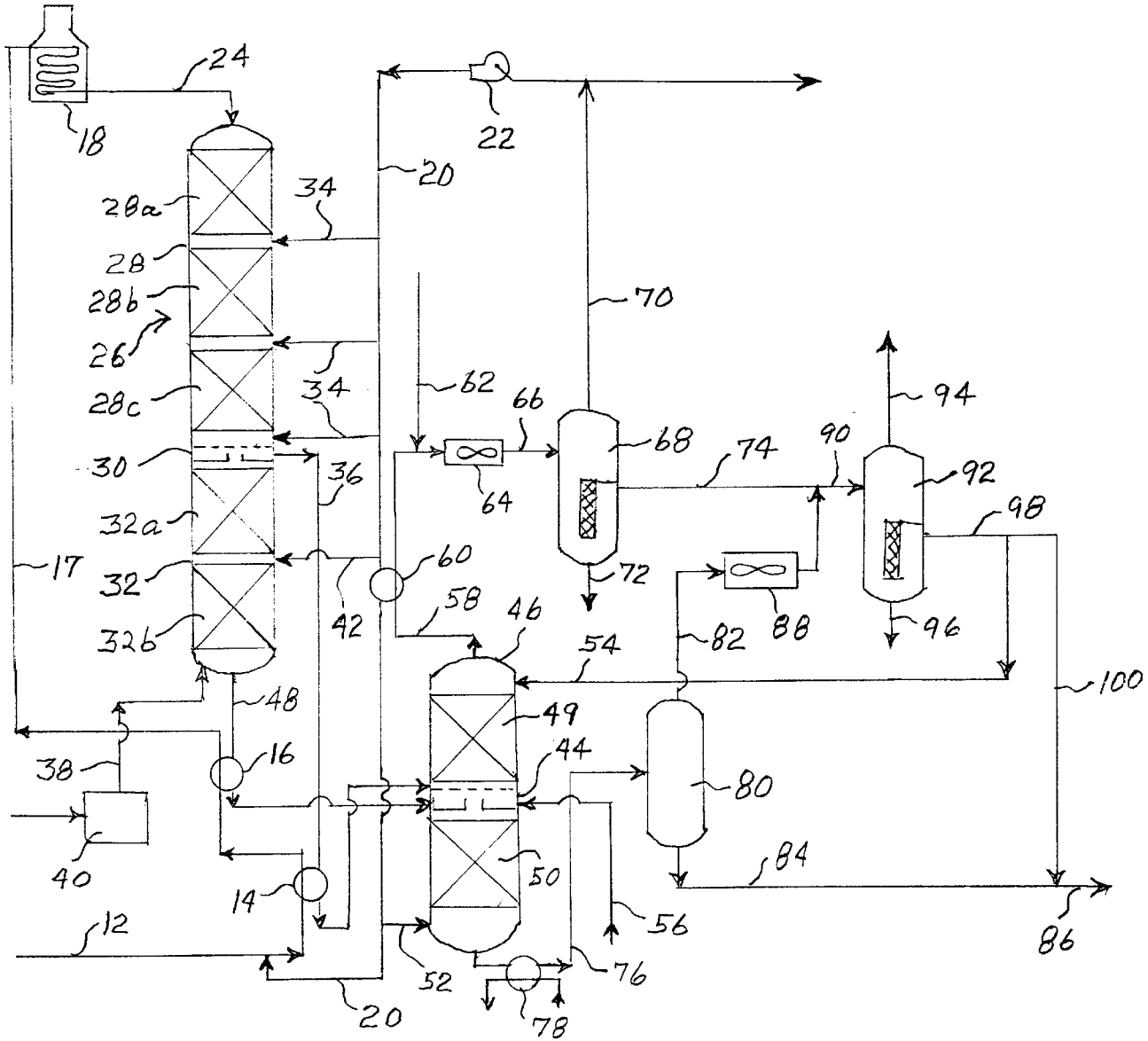
12
14
16
17
18
20
22
24
26
28
28a
28b
28c
30
32
32a
32b
34
36
38
40
42
44
46
48
49
50
52
54
56
58
60
62
64
66
68
70
72
74
76
78
80
82
84
86
88
90
92
94
96
98
100

HYDROCRACKING OF VACUUM GAS AND OTHER OILS USING A COCURRENT/COUNTERCURRENT REACTION SYSTEM AND A POST-TREATMENT REACTIVE DISTILLATION SYSTEM

BACKGROUND OF THE INVENTION

The invention relates to the hydrocracking of vacuum gas oil or various other typical hydrocracking feedstock oils or mixtures thereof.

In hydrocracking technology, reactor operating conditions are dictated either by product quality requirements or by catalyst life. It is impossible to optimize processing conditions in a single reactor because operating conditions in the reactor are set by the most difficult components of the feed. For example, the conditions in the reactor could be set by the amount of nitrogen in the feed. Typically, in the first reactor treating raw feed, conditions are severe (high-temperature) and not conducive to aromatic saturation. Moreover, once products are formed from hydrocracking reactions, they compete with the heaviest fractions of the feed (nominally 700° F.+material) to gain access to the active catalyst sites. Occlusion of the products (700° F.−material) from the active sites by the heavy products is very likely.

Consequently, for a given conversion level, single reactor systems operating at the same pressure levels as multi-reactor systems produce inferior quality products. In order to compensate for this shortfall in product quality, units are run at higher pressures and with lower space velocities. In most cases, there is considerable giveaway in product quality for at least one major product especially at start-of-run conditions, as operators select an operating pressure level to guarantee the quality of all products and extend the catalyst run length. For example, the hydrocracked Jet/Kerosene Smoke Point is often 30 mm at start-of-run when the specification requires 20 mm. Similarly, the hydrocracked Diesel Cetane Index is often around 60 when the required value is 50. This product quality giveaway translates to a waste of hydrogen. In most refineries, hydrogen is an expensive commodity.

SUMMARY OF THE INVENTION

The present invention relates to a hydrocracking and hydrotreating process which minimizes hydrogen consumption and reduces the overall reactor and catalyst volumes for a given level of performance for the production of diesel oil and lighter materials including kerosene and naphtha. The invention includes a first hydrogenation process in a main reactor employing a combination of cocurrent and countercurrent processing. The hydrocracking feedstock oils together with hydrogen are fed down through the top section of the main reactor containing a layered system of hydrotreating and hydrocracking catalysts for the cocurrent processing. Below the top section is a vapor/liquid disengaging zone where vapor and liquid are separated and the vapor containing the majority of the hydrogen sulfide and ammonia formed by hydrotreating and the majority of the diesel oil and lighter materials formed by hydrocracking are withdrawn. The separated liquid then flows down through the lower section also containing catalyst beds for the countercurrent processing. High purity make-up hydrogen is introduced up into the bottom of the reactor which flows up countercurrent to the downflowing liquid for further hydrogenation and for stripping the diesel and lighter materials present or formed in the lower countercurrent section. The bottoms containing primarily the uncracked heavy oil fraction together with some diesel and lighter materials and the separated vapors from the vapor/liquid disengaging zone are then processed in a post-treatment reactor to complete the hydrotreating and hydrocracking for final product quality and to facilitate the nitrogen and sulfur separation. The process using the cocurrent/countercurrent main reaction system with make up hydrogen addition at the bottom in combination with the post-treatment reaction system favors sulfur and nitrogen removal and aromatic saturation as well as final product yields and quality using lower reactor volume, lower catalyst volume, increased catalyst run length and lower hydrogen consumption.

BRIEF DESCRIPTION OF THE DRAWING

The drawing is a process flow diagram illustrating the invention.

DESCRIPTION OF THE PREFERRED EMBODIMENTS

The invention relates to the hydrocracking and hydrotreating of various oils from distillation or from solvent extraction nominally boiling between 600 or 700° F. up to about 1500° F. In particular, the invention relates to the hydrocracking and hydrotreating of vacuum gas oil or various other known feedstock oils typically processed by hydrocracking such as light cycle oil, coker gas oil, visbreaker gas oil and deasphalted oil. Typically, vacuum gas oil forms the bulk of the feed usually with some quantity of one or more of the other oils. By way of explanation, vacuum gas oil is that fraction of the crude oil that typically boils between about 600° F. and 1200° F. and is derived by the vacuum distillation of residue from the atmospheric distillation column in a petroleum refinery. Depending on the crude source and the boiling range, the composition of paraffins, naphthenes and aromatics and the level of contaminants like sulfur, nitrogen, metals, asphaltenes, etc. can vary widely. Vacuum gas oil is the primary component of feedstock to conversion units such as hydrocracking. A typical vacuum gas oil has the following properties:

Specific Gravity: 0.85 to 0.98

Total Nitrogen, ppm: 100 to 5000

Total Sulfur, ppm: 0.1 to 4.0

Metals (Ni+V), ppm: 0.1 to 2

Distillation range: 600° F. to 1200° F.

Light cycle oil is the light distillate obtained from fluid catalytic cracking of vacuum gas oil in a petroleum refinery. The typical boiling range is 400° F. to 800° F. Light cycle oil is a highly aromatic compound (40–90 wt. % aromatics) and is also high in sulfur. Visbreaker gas oil is the distillate obtained after the fractionation of products obtained from thermally cracking vacuum residue in a visbreaking process. It is high in olefins, nitrogen and sulfur. The typical boiling range is 600° F. to 1000° F. Deasphalted oil is obtained after solvent extraction of the vacuum residue fraction of crude oil in a solvent deasphalting unit. The solvent is typically propane, butane or pentane and the deasphalted oil is high in metals, nitrogen and sulfur. The typical boiling range is 900° F. to 1500° F.

Referring to the flow diagram of the drawing, a preheated feed 12 of vacuum gas oil and/or other typical hydrocracking feedstock oils, such as coker gas oil and visbreaker gas oil, is fed through and further heated in the heat exchangers 14 and 16 and then fed in line 17 to the feed heater 18 in admixture with the hydrogen-rich gas from line 20.

The hydrogen-rich gas in line 20 is the hydrogen-rich recycle from the recycle compressor 22.

The heated mixture of feed oil and hydrogen is fed in line 24 from the feed heater 18 to the top of the main reactor 26. The main reactor 26 is a cocurrent/countercurrent reactor containing an upper cocurrent section generally designated 28, a center vapor/liquid disengaging zone and a lower countercurrent section 32. The upper cocurrent section is illustrated as including three catalyst beds 28*a,* 28*b* and 28*c* although there could be more or fewer catalyst beds for any particular feed material and operating situation. The lower countercurrent section 32 contains the two catalyst beds 32*a* and 32*b* but once again there could be more or fewer.

The heated feed 24 containing the feed oil and the hydrogen is passed down through the catalyst beds 28*a,* 28*b* and 28*c* with hydrogen-rich recycle vapor from line 20 being injected at the locations 34 between the catalyst beds to maintain a desired hydrogen partial pressure and as a quench to keep the reaction temperature from rising too high as a result of the exotheric reactions.

In this top, cocurrent section 28, anywhere from 5% to 90% of the feed will be converted to diesel and lighter materials with boiling points nominally below about 700° F. depending on the particular feed oil. Also, a large percentage of the sulfur and nitrogen will be removed from the feed oil by hydrodesulfurization and hydrodenitrification to form hydrogen sulfide and ammonia. In the vapor/liquid disengaging zone 30, the vapor from the upper cocurrent section and the vapor from the lower countercurrent section, as both described in more detail below, are separated and withdrawn from the reactor 26 as the side stream 36.

The liquid separated from the vapor in the vapor/liquid disengaging zone 30 is redistributed over the catalyst beds in the bottom countercurrent section 32 and flows downwardly countercurrent to the hydrogen flowing up. All of the make-up hydrogen 38 from the hydrogen compressor 40 that is required for the reactions is fed to the bottom of the reactor 26. The make-up hydrogen is the purest hydrogen stream in the process and the introduction from below the bottom catalyst beds 32*a* and 32*b* leads to a higher hydrogen partial pressure in the countercurrent section 32 than would otherwise be possible. This higher hydrogen partial pressure favors aromatic saturation and greatly reduces catalyst deactivation. This results in less catalyst being needed to achieve a specific level of performance. Also, the operating temperatures in the bottom catalyst beds are lower because of the removal of the sulfur and nitrogen. This lower temperature also favors aromatic saturation. As in the upper section, the hydrogen-rich vapor from the recycle stream 20 is introduced at 42 between the catalyst beds for quench, stripping out light end products and maintenance of the hydrogen partial pressure. The catalysts in the main reactor, as well as the post treatment reactor discussed later, may be any conventional hydrogenation catalyst such as those from the following list:

Nickel-molybdenum on alumina

Nickel-molybdenum on silica-alumina with zeolites

Paladium/alumina/zeolite

Nickel/tungsten/titanium silica-alumina with zeolites

Nickel/tungsten on zeolite

Cobalt-molybdenum on alumina

Cobalt-molybdenum on zeolite

The catalyst metals may be impregnated, co-gelled or co-mulled on the base.

For a typical light vacuum gas oil feed with a feed rate of 35,000 barrels per day and containing 800 ppm nitrogen and 2.3 weight percent sulfur, a typical example of the operating conditions within the main reactor 26 are as follows:

| | |
|---|---|
| $H_2$-rich gas with feed | range 50–30 million standard $ft^3$/day<br>typical 175 million standard $ft^3$/day |
| Recycle quench gas | range 0–200 million standard $ft^3$/day<br>typical 105 million standard $ft^3$/day |
| Make-up hydrogen | range 10–70 million standard $ft^3$/day<br>typical 35 million standard $ft^3$/day |
| Cocurrent section: | |
| Weighted Average Bed Temperature of Catalyst, ° F.: | range 550–800<br>typical 730° F. |
| Average Pressure, psig | range 1000–3500<br>typical 2300 psig |
| Counter-current section: | |
| Weighted Average Bed Temperature of Catalyst, ° F.: | range 530–800<br>typical 690° F. |
| Average Pressure, psig | range 1000–3500<br>typical 2250 psig |

The vapor stream 36 from the vapor/liquid disengaging zone 30 is the combined vapor from the cocurrent section 28 and the countercurrent section 32 and contains most of the diesel and lighter materials, most of the hydrogen sulfide and ammonia and any unreacted hydrogen. This stream 36 is cooled at 14 by the transfer of heat to the incoming feed stream 12 and is then fed to the center feed section 44 of the post treatment reactor 46. The bottoms 48 from the main reactor 26 contains mainly the uncracked heavy hydrotreated oil having a nominal 700° F.+boiling point. This bottoms stream 48 will also contain some diesel and lighter materials. The bottoms stream 48 is cooled at 16 also by the transfer of heat to the incoming feed stream 12 and is then also fed to the center feed section 44 of the post treatment sector 46.

The post-treatment reactor 46 contains an upper bed 49 above the feed section 46 and a lower bed 50 below the feed section 46. Hydrogen 52 is fed to the bottom of the post-treatment reactor 46 and flows up through both beds. A small quantity of cold reflux 54 is added to the top of the post-treatment reactor as a cooling quench and to wash down any unconverted oil. The upper bed 49 is a hydrogenation catalyst bed. The vapor fraction of the feed, essentially the diesel and lighter materials and the hydrogen sulfide and ammonia, flows up through the bed 49 in contact with the hydrogen flowing up in a cocurrent manner to complete the hydrogenation of these products. In the bottom bed 50, the liquid portion of the feed, essentially the unconverted heavy oil with some diesel and perhaps lighter material, is stripped of the diesel and lighter material by the hydrogen moving up through the bed counter-current to the liquid flowing down. Depending on the degree of post treatment required for any particular situation, the bottom bed 50 can be packed with either a highly efficient inert structural packing for stripping or with an active hydrotreating catalyst for reactive stripping. If light cycle oil 56 obtained from the fluid catalytic cracking of vacuum gas is a desired feed component, it is preferably fed to the process after the main reactor 26 and prior to the post-treatment reactor 46 because it can cause rapid catalyst deactivation. However, it can also be fed to the main reactor 26 along with the other oils. Following up on the specific operating conditions previously recited, a specific example of the operating conditions in the post-treatment reactor 46 are as follows:

| | |
|---|---|
| Average bed temperature | range 500 to 750° F.<br>typical 675° F. |
| Operating pressure | range 1000 to 3500 psig<br>typical 2300 psig |
| Hydrogen feed | range 2 to 30 million standard $ft^3$/day<br>typical 9 million standard $ft^3$/day |

The vapor effluent 58 from the post-treatment reactor 46 contains the diesel and lighter distillate products along with the hydrogen sulfide and ammonia and unreacted hydrogen. The effluent 58 is partially cooled by heat exchange at 60 against the hydrogen-rich recycle stream 20. The partially cooled stream 58 is then injected with water at 62 to prevent the deposition of ammonium bisulfide that may form when the reactor effluent is being cooled. The partially cooled effluent stream 58 is then cooled further at 64 to condense the product hydrocarbons, such as the diesel oil, kerosene and naphtha, leaving the hydrogen and some lighter hydrocarbons as vapor. The stream 66 is now a three-phase mixture of gases, liquid hydrocarbon and an aqueous phase. These three phases are separated in the cold high-pressure separator 68 with the hydrogen-rich gaseous phase 70 forming the recycle to the recycle compressor 22 and with the sour water phase being discharged at 72. The liquid hydrocarbon phase is discharged at 74.

Returning now to the post-treatment reactor 46, the bottoms 76 containing primarily unconverted oil is cooled at 78 to recover heat. Then the unconverted oil is flashed to recover light hydrocarbons which are then separated in the hot low-pressure separator 80 as the vapor stream 82. The bottoms 84 from the hot low-pressure separator 80 form a portion of the combined product stream 86. The vapor stream 82 from the hot low-pressure separator 80 is cooled at 88 and combined with the hydrocarbon effluent 74 from the cold high-pressure separator 68. This forms the stream 90 which again is a three-phase stream which is separated at 92 to form the vapor stream 94, the sour water stream 96 and the hydrocarbon product stream 98. The vapor stream 94 containing some hydrogen is sent for recovery of that hydrogen and any other desired constituents.

A portion of the hydrocarbon product stream 98 is withdrawn to form the reflux 54 to the post-treatment reactor 46. The remaining hydrocarbon product stream 100 is combined with the unconverted oil stream 84. The total product stream 86 is then sent for separation by distillation into the various components such as diesel oil, kerosene, naphtha and unconverted oil.

In the present invention, the combination of the cocurrent/countercurrent main reactor and the post-treatment reactor reduces the overall catalyst volume, the reactor weight, the hydrogen consumption, the product giveaway and increases the process flexibility. The reactions are operated at conditions including the hydrogen level and space velocity whereby the unconverted oil is only treated to the level necessary to meet the quality requirements such as saturation of aromatics and hydrodesulfurization and hydrodenitrification. The selective addition of hydrogen in the reactors, as opposed to the addition of all of the hydrogen in a single reactor under non-optimum conditions, leads to a significant reduction in hydrogen consumption, perhaps by 5–30%. Further, the operating pressures can be lowered for the same catalyst volume, perhaps by about 5–30%, or the catalyst volume can be lowered by about 5–30% at the same operating pressure.

What is claimed is:

1. A method of hydrocracking and hydrotreating a hydrocracking feedstock oil selected from the group consisting of vacuum gas oil, light cycle oil, coker gas oil, visbreaker gas oil, deasphalted oil and mixtures thereof containing sulfur and nitrogen and aromatics for the production of distillates comprising diesel oil, kerosene and naphtha comprising the steps of:

a. providing a first reactor having an upper cocurrent reaction section containing a hydrogenation catalyst and a lower countercurrent reaction section containing a hydrogenation catalyst and having a vapor/liquid disengaging zone between said upper and lower reaction sections;

b. heating said feedstock oil to a catalytic hydrotreating and hydrocracking temperature;

c. passing said heated feedstock oil and hydrogen down through said upper cocurrent reactor section whereby said feedstock oil is at least partially hydrodesulfurized and hydrodenitrified and said aromatics are at least partially saturated and whereby said feedstock oil is partially cracked thereby forming in said vapor/liquid disengaging zone a vapor containing cracked oil vapors and hydrogen sulfide and ammonia and a liquid containing uncracked heavy oil;

d. passing said liquid containing said uncracked heavy oil from said vapor/liquid disengaging zone down through and additional hydrogen up through said lower countercurrent reactor section whereby said liquid uncracked heavy oil is further hydrotreated and hydrocracked producing additional vapor in said vapor/liquid disengaging zone and producing liquid bottoms containing uncracked heavy oil;

e. withdrawing said vapor from said vapor/liquid disengaging zone of said first reactor and said bottoms from said first reactor;

f. further hydrotreating said withdrawn vapor and said withdrawn bottoms comprising the steps of introducing said withdrawn vapor and said withdrawn bottoms into a post treatment reactor between an upper hydrogenation catalyst bed and a lower stripping section and introducing further hydrogen into the bottom of and up through said post treatment reactor and thereby further hydrogenating said withdrawn vapor and said withdrawn bottoms and stripping said withdrawn bottoms thereby producing said distillates.

2. A method as recited in claim 1 and further including the step of cooling said withdrawn vapors prior to introduction into said post treatment reactor.

3. A method as recited in claim 2 and further including the step of cooling said withdrawn bottoms prior to introduction into said post treatment reactor.

4. A method as recited in claim 1 wherein said additional hydrogen passed up through said lower countercurrent reactor section comprises make-up hydrogen.

5. A method as recited in claim 1 wherein said upper cocurrent reactor section and said lower countercurrent reactor section each contains a plurality of hydrogenation cataylst beds and further comprising the step of introducing a hydrogen-rich gas stream into said first reactor between said plurality of beds.

* * * * *

UNITED STATES PATENT AND TRADEMARK OFFICE

CERTIFICATE OF CORRECTION

PATENT NO. : 6,514,403 B1
DATED : February 4, 2003
INVENTOR(S) : Louie et al.

It is certified that error appears in the above-identified patent and that said Letters Patent is hereby corrected as shown below:

Column 6,
Line 61, please delete “contains” and insert -- contain --.
Line 62, please delete “cataylst” and insert -- catalyst --.

Signed and Sealed this

Twenty-ninth Day of June, 2004

JON W. DUDAS
*Acting Director of the United States Patent and Trademark Office*